US006672335B1

(12) United States Patent
Welborn

(10) Patent No.: US 6,672,335 B1
(45) Date of Patent: Jan. 6, 2004

(54) AUTOMATED DUMP SAND SEPARATOR CONTROL SYSTEM

(76) Inventor: Kyle N. Welborn, 3001 Arroyo, Apt. #208, Victoria, TX (US) 77901

( * ) Notice: Subject to any disclaimer, the term of this patent is extended or adjusted under 35 U.S.C. 154(b) by 325 days.

(21) Appl. No.: 09/949,489

(22) Filed: Sep. 10, 2001

(51) Int. Cl.[7] ..... F16K 31/02
(52) U.S. Cl. ..... 137/624.11; 137/624.13
(58) Field of Search ..... 137/624.11, 624.13, 137/624.14, 624.15; 166/105.1, 227, 311

(56) References Cited

U.S. PATENT DOCUMENTS 5,921,270 A * 7/1999 McCarty ..... 137/624.13
6,089,269 A * 7/2000 Essam ..... 137/624.15
6,158,512 A * 12/2000 Unsgaard ..... 166/105.1
6,241,014 B1 * 6/2001 Majek et al. ..... 166/53
6,405,995 B1 * 6/2002 Spain ..... 251/129.11

* cited by examiner

*Primary Examiner*—Kevin Lee

(57) ABSTRACT

An automated dump sand separator control system for controlling a three-way pneumatic dump valve of a well sand separator. The system controls a three-way pneumatic dump valve which is attached to a sand separator for dumping material from a well pumping system. A first timer is used for controlling the time intervals between dumping cycles. A second timer is connected to the first timer and controls the time duration for each cycle. The first timer activates the second timer. Each cycle opens and closes the pneumatic normally closed two-way valve by a three-way solenoid valve. The first and second timer are powered by a rechargeable battery that is kept charged by a solar panel that has a shunt regulator for dropping the voltage from the solar panel. The solar panel is mounted on a vertical support member through a pair of adjustable support arms for adjusting the angle of solar panel to the sun.

13 Claims, 3 Drawing Sheets

AUTOMATED DUMP SAND SEPARATOR CONTROL SYSTEM

BACKGROUND OF THE INVENTION

1. Field of the Invention

The present invention relates to an automated dump sand separator control system and more particularly pertains to automated timed dumping and separating of sand from a well sand separator system using simple and effective components.

2. Description of the Prior Art

The use of timed valve actuating devices of various designs and configurations is known in the prior art. For example, U.S. Pat. No. 5,957,200 to Majek et al. effectively discloses a microprocessor based controller for oil or gas wells using a plunger lift device. The microprocessor is connected to a valve and the controller acts as a timer that corresponds to the position of the plunger. The disclosure also teaches the use of a solar voltaic panel to power the control system.

U.S. Pat. No. 4,535,813 to Spain basically discloses a solar energy operated irrigation surge valve. The disclosure teaches the use of a programmable timer, a storage battery and a solar panel for recharging the storage battery in combination with a rack and pinion drive assembly for controlling an irrigation surge valve.

U.S. Pat. No. 5,294,051 to Piegari discloses a valve controller for a hot water heating system for a building. The valve controller has a flow timer for variably establishing flow periodicity between a minimum flow time and a maximum flow time and a base cycle timer for variably establishing base cycle periodicity between a minimum base time and a maximum base time.

U.S. Pat. No. 4,256,133 to Coward et al. discloses a water flow control device having an on-off valve, an electronic circuit including a first timer for maintaining the sprinkling valve on for a predetermined time after sunlight occurs and a second timer for maintaining the valve on for a second predetermined time following moisture detection by a ground probe. The disclosure also discloses the circuit and valve operated by batteries that are charged by a solar panel.

U.S. Pat. No. RE 34,111 to Wynn discloses a system for automatically operating a gas and oil producing well of the plunger lift type having a 12 volt solar panel for maintaining a full charge on a battery supply of the system.

U.S. Pat. No. 3,559,731 to Stafford discloses a timed system for controlling a well pump having a first timer and a second timer connected to the contacts of the pump.

U.S. Pat. No. 6,173,768 to Watson discloses an improved method and apparatus for down-hole oil/water separation during pumping operations having a timer switch to control the opening and closing of automatic control valve, at specified time intervals.

U.S. Pat. No. 5,494,102 to Schulte discloses a down-hole hydraulically operated pump having flow blocking valves with a solenoid connected to a timing device. The timing device is adjusted to provide time windows for the operating sequence of the pump assembly in a well.

U.S. Pat. No. 6,059,030 to Celestin discloses a sand recovery unit for removing sand and other clogging debris from a producing well formation having a switch assembly including a time delay set to continue activation of a battery powered pump for a predetermined time after contact of the case with the bottom of the well.

Lastly, U.S. Pat. No. 4,251,358 to Mozley basically discloses a sand separator having pneumatic timers.

While these devices fulfill their respective, particular objectives and requirements, the aforementioned patents do not describe an automated dump sand separator control system that allows automated and programmable timed dumping and separating of sand from a well sand separator system using simple and effective components.

In this respect, the automated dump sand separator control system according to the present invention substantially departs from the conventional concepts and designs of the prior art, and in doing so provides an apparatus primarily developed for the purpose of automated timed dumping and separating of sand from a well sand separator system using simple and effective components.

Therefore, it can be appreciated that there exists a continuing need for a new and improved automated dump sand separator control system which can be used for automated timed dumping and separating of sand from a well sand separator system using simple and effective components. In this regard, the present invention substantially fulfills this need.

SUMMARY OF THE INVENTION

In view of the foregoing disadvantages inherent in the known types of timed valve actuating devices of various designs and configurations now present in the prior art, the present invention provides an improved automated dump sand separator control system. As such, the general purpose of the present invention, which will be described subsequently in greater detail, is to provide a new and improved automated dump sand separator control system and method which has all the advantages of the prior art and none of the disadvantages.

To attain this, the present invention essentially comprises an automated dump sand separator control system for controlling a pneumatic sand separator dump valve having a solar panel mounted on a vertical support member by a pair of adjustable support arms. A shunt regulator connected to the solar panel for decreasing the voltage supplied by the solar panel. A rechargeable battery is connected to the shunt regulator which provides power to the automated dump sand separator control system. A first timer is connected to the battery for controlling time intervals between dumping cycles. A second timer is connected to the first timer for controlling the time duration of a three-way solenoid valve. The second timer is controlled by the first timer. A housing is attached to the vertical support member and encloses the first timer and the second timer in an environmentally sealed compartment. A pneumatically controlled normally closed two-way valve is connected to the three-way solenoid valve that activated dumps material from a sand separator.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automated dump sand separator control system which has all of the advantages of the prior art timed valve actuating devices of various designs and configurations and none of the disadvantages.

It is another object of the present invention to provide a new and improved automated dump sand separator control system which may be easily and efficiently manufactured and marketed.

It is further object of the present invention to provide a new and improved automated dump sand separator control system which is of durable and reliable constructions.

An even further object of the present invention is to provide a new and improved automated dump sand separator control system which is susceptible of a low cost of manufacture with regard to both materials and labor, and which accordingly is then susceptible of low prices of sale to the consuming public, thereby making such automated dump sand separator control system economically available to the buying public.

Even still another object of the present invention is to provide an automated dump sand separator control system for automated timed dumping and separating of sand from a down-hole pumping system using simple and effective components.

Lastly, it is an object of the present invention to provide a new and improved automated dump sand separator control system for controlling a pneumatic sand separator normally closed two-way valve having a solar panel connected to a battery for recharging the battery. The battery is connected to a first timer and a second timer. The first timer controls the time intervals between dumping cycles. The second timer is connected the first timer and upon activation controls the time duration of a sand separator dump valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
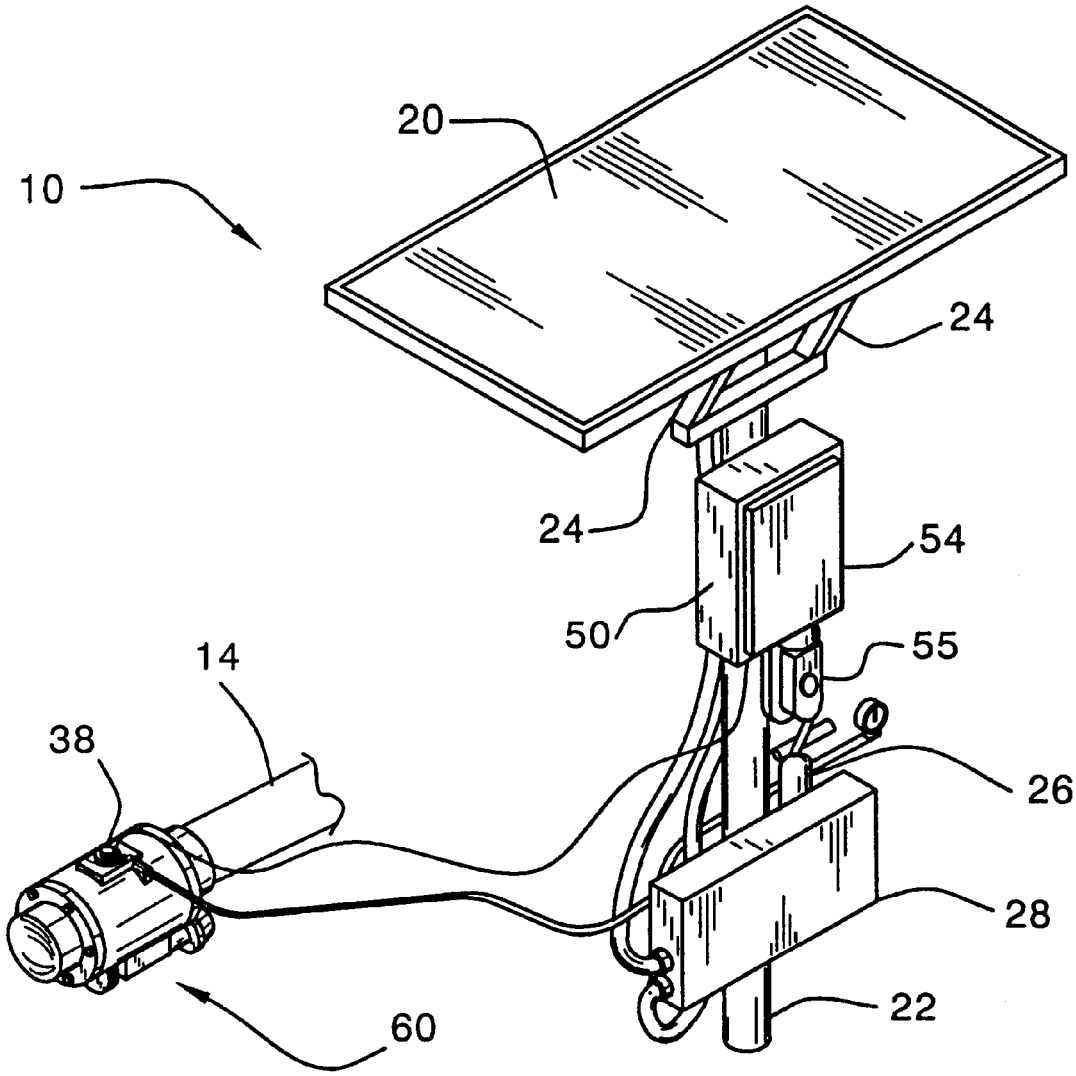
FIG. 1 is a perspective view of the preferred embodiment of the automated dump sand separator control system constructed in accordance with the principles of the present invention.

With reference now to the drawings, and in particular to FIG. 1 thereof, a new and improved automated dump sand separator control system 10 for the automatic timed dumping and separating of material from a well sand separator system 14 will be described. More particularly, the automated dump sand separator control system 10 has a solar panel 20, a housing 50 and a rechargeable battery 28. A pair of adjustable support arms 24 mounts the solar panel 20 to the top end of a vertical support member 22. The solar panel 20 may have a swivel joint connector located on its underside to allow for angular adjustability to maximize power production of the solar panel by positioning the solar panel orthogonal to the sun or any other light source.

A shunt regulator 26 is connected to the solar panel 20 to decrease the voltage from the solar panel to a voltage compatible with the rechargeable battery 28. Preferably, the shunt regulator 26 should decrease the voltage to about 14.65 V at 258 C (778 F) respectively. The rechargeable battery 28 is removably attached to the vertical support member 22 and can be mounted in a location remote from the solar panel. The shunt regulator 26 can be an integral component of the solar panel 20 or an optional separate component.

Figure 2:
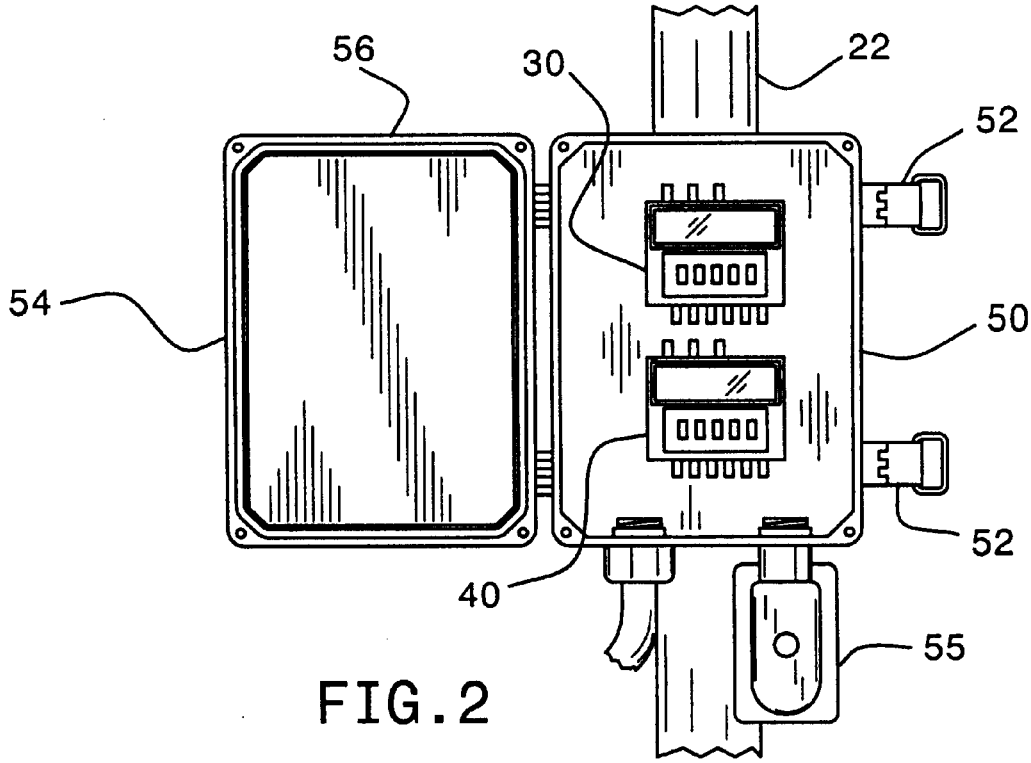
FIG. 2 is a front elevation view of the timer control system and housing with the door in an open position of the present invention.

As best illustrated in FIG. 2, the housing 50 has a generally rectangular configuration and is adaptively mounted to the vertical support member 22. A lid 54 is connected to the housing 50 by a hinges and has a seal 56 located on the inner side of the lid recessed within a groove running along the periphery of the lid. The lid 54 and the seal 56 produce an environmentally sealed compartment within the housing 50 when the lid is closed. The lid 54 is secured to the housing 50 by latches 52. The latches 52 can be any standard latch or closure retaining device. The housing 50 is adapted to retain a first timer 30 and a second timer 40 within the housing compartment to protect the timers from environmental conditions. The back panel of the housing 50 is adapted to be able to accept multiple timers and is configured so as not to impede with the support member 22 housing mounting assembly. The housing 50 also contain multiple access ports for the passage or wires, cables, hoses, etc. to and from the housing internal compartment that houses the timers 30 and 40.

Figure 3:
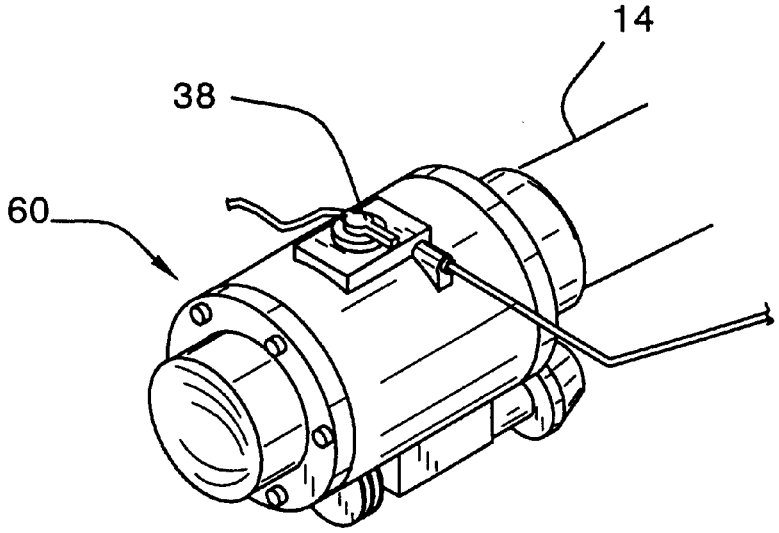
FIG. 3 is a perspective view of the pneumatic valve connected to a well sand separator tube of the present invention.

A valve assembly 60, best illustrated in FIG. 3, having a pneumatically controlled normally closed two-way valve 38 is connected to an installed well sand separator system 14 for dumping sand or any unwanted material from a well pumping system. The two-way valve 38 is controlled by a three-way solenoid valve 55 which is connected to a pressurized air supply 26. The pressurized air supply 26 can be a pressure vessel, an air compressor or any device that can supply pressurized air that is sufficient to activate the three-way solenoid valve 55. Furthermore, pressurized gasses collected from the well may be used to activate the two-way valve 38 providing for a more inexpensive and reliable pressure supply. The three-way solenoid valve 55 controls the amount of air supplied to the normally closed two-way valve 38 to properly activate the two-way valve allowing for the dumping of material from the sand separator 14. The three-way solenoid valve 55 pressurizes the normally closed two-way valve 38 and when the three-way solenoid valve 55 is de-activated it relieves pressure through a quick bleed port which engages a quick bleed port on the two-way valve 38. Preferably, the pressure needed to activate the normally closed two-way valve 38 is about a range from 80 to 125 psi.

Figure 4:
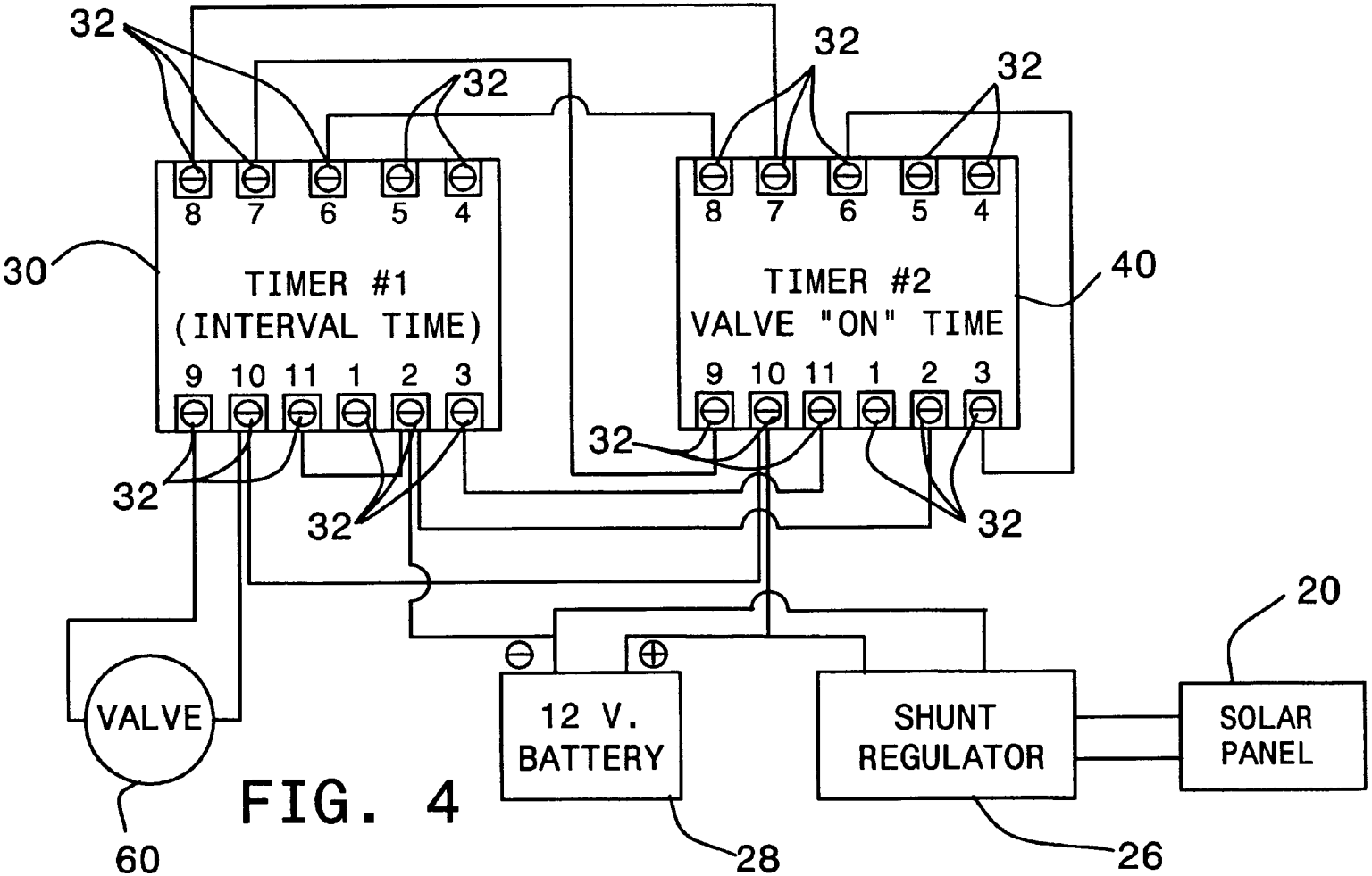
FIG. 4 is a schematic diagram of the timer control system of the present invention.

The first timer 30 and the second timer 40 are solid state timers each having eleven connection terminals 32. The connection terminal number 2 of the first timer 30 is connected to terminal 11 of the first timer, the negative terminal of the rechargeable battery 28 and terminal 2 of the second timer 40. Terminal 3 of the first timer 30 is connected to terminal 11 of the second timer 40. Terminal 6 of the first timer 30 is connected to terminal 8 of the second timer 40. Terminal 7 of the first timer 30 is connected to terminal 9 of the second timer 40. Terminal 8 of the first timer 30 is connected to terminal 7 of the second timer 40. Terminal 10 of the first timer 30 is connected to the normally closed two-way valve 38 and to terminal 10 of the second timer 40. Terminal 9 of the first timer is connected to the normally closed two-way valve 38. Terminal 3 of the second timer 40 is connected to terminal 6 of the second timer. Terminal 10 of the second timer 40 is connected to positive terminal of the rechargeable battery 28. Terminal connections and the wiring for the first timer 30 and the second timer 40 are best illustrated in FIG. 4.

In use, it can now be understood that the automated dump sand separator control system is a self-contained programmable control system. Power is supplied by the rechargeable battery which is kept charged by the solar panel through the shunt regulator.

For use in the invention as a source of electric power, a 12V rechargeable sealed AGM Deep Cycle battery is preferred, but any 12V-power supply can be used. Solar power is the preferred method of recharging the battery because of its simplicity and reliability. However, other sources of energy, such as those powered by fossil fuel; wind; and hydro energy might be employed to advantage depending on location. Typical solar panel modules are sold by Solarex, Frederick, Md.; Uni-solar, Troy, Mich.; BP International; and Sigmans. Preferably, the Solarex SX 60u (60 amp) or the Sigmans Sp70 Photovoltaic module (60 amp) is used along with a Solarex SRX-12 (12 amp) shunt regulator. The shunt regulator is used to drop the voltage from the solar panel to about 14.65 V at 25° C. (778 F) respectively.

The first timer and the second timer are both solid-state timers, preferably Omron model H3CA solid state timers which have a programmable time span from 1 second to 999 hours. Both timers are connected to the battery which is connected to the solar panel to provide for a self-contained automated timed based control system. The first timer is used to control the time interval between dumping cycles from the normally closed two-way valve of the well sand separator system. Preferably, a 30"×10'–3000 psi sand separator is used. However, other sand separators might be used. The second timer is connected to the first timer and is used to control the time duration for each dumping cycle.

The sand is separated and dumped from the well pumping system by the sand separator through the pneumatic dump normally closed two-way valve. The pneumatic normally closed two-way valve is connected to the three-way solenoid valve which controls the amount of air supplied to the two-way valve from the pressurized air source. Preferably, a 1"×2"1502 stb 15 m plug valve is used. The two-way valve opens when air pressure in the rang of about 80 to 125 psi is supplied to it and closes when pressure is released through a quick bleed port.

In operation, when the first timer times out, power is supplied to the second timer. The second timer activates the three-way solenoid valve which sends pressurized air to the normally closed two-way valve. The two-way valve remains open for the duration set by the second timer. When the second timer reaches its programmed time limit and times out, power is supplied back to the first timer. This cycle repeats itself until power to the timers is disconnected.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automated dump sand separator control system comprising, in combination:

a solar panel mounted on a vertical support member by at least one adjustable support arm for adjusting the angular position of said solar panel toward a light source;

a shunt regulator connected to said solar panel for decreasing the voltage from said solar panel;

a rechargeable battery connected to said shunt regulator for providing power to said automated dump sand separator control system;

a first timer connected to said battery for controlling the intervals of an operational cycle of said automated dump sand separator control system;

a second timer connected to said battery and said first timer for controlling the time duration of each operational cycle from said first timer, said second timer being activated when said first timer times out, said first timer reactivates when said second timer times out;

a three-way solenoid valve connected to said second timer for controlling a device connected to said three-way solenoid valve for a time duration from said second timer;

a pneumatically controlled normally closed two-way valve connected to said three-way solenoid valve and attached to a well sand separator for dumping material from said well sand separator; and a housing attached to said vertical support member for enclosing said first timer and said second timer in an environmentally sealed compartment.

2. A automated dump sand separator control system for controlling a sand separator dump valve comprising, in combination:

a solar panel mounted on a support member by at least one adjustable support arm for adjusting the angular position of said solar panel toward a light source;

a shunt regulator connected to said solar panel for decreasing the voltage from said solar panel;

a rechargeable battery connected to said shunt regulator for providing power to said automated dump sand separator control system;

a first timer connected to said battery for controlling the intervals of an operational cycle of said automated dump sand separator control system;

a second timer connected to said battery and said first timer for controlling the time duration of each operational cycle from said first timer, said second timer being activated when said first timer times out, said first timer reactivates when said second timer times out;

a solenoid valve connected to said second timer for controlling a device connected to said solenoid valve for a time duration from said second timer; and a pneumatically controlled valve connected to said solenoid valve and attached to a well sand separator for dumping material from said well sand separator.

3. A automated dump sand separator control system for controlling a sand separator dump valve comprising:

a power supply unit mounted on a support member;

a first timer connected to said power supply for controlling the intervals of an operational cycle of said automated dump sand separator control system;

a second timer connected to said power supply and said first timer for controlling the time duration of each cycle from said first timer and wherein said second timer being activated by said first timer; and a valve connected to said second timer and attached to a well sand separator for dumping material from said well sand separator.

4. The automated dump sand separator control system as set forth in claim 3 wherein said power supply is a solar panel.

5. The automated dump sand separator control system as set forth in claim 4, further comprising a shunt regulator connected to said power supply for decreasing the voltage from said power supply.

6. The automated dump sand separator control system as set forth in claim 5, further comprising a rechargeable battery connected to said shunt regulator.

7. The automated dump sand separator control system as set forth in claim 3 wherein said power supply is a battery.

8. The automated dump sand separator control system as set forth in claim 3 where in said valve is a pneumatic dump valve.

9. The automated dump sand separator control system as set forth in claim 8, further comprising a solenoid valve connected to said second timer for controlling said pneumatic dump valve for a time duration corresponding to the time duration from said second timer.

10. The automated dump sand separator control system as set forth in claim 3, further comprising a housing attached to said support member for enclosing said first timer and said second timer in an environmentally sealed compartment.

11. The automated dump sand separator control system as set forth in claim 3 wherein said support member is a vertically oriented elongated pole.

12. The automated dump sand separator control system as set forth in claim 4, further comprising at least one adjustable support arm attached to said solar panel and said support member.

13. A valve control system comprising:

a power supply unit;

a first timer connected to said power supply unit for controlling an operational cycle;

a second timer connected to said power supply unit and to said first timer for controlling the time duration of said operational cycle upon activation from said first timer;

a solenoid valve connected to said second timer; and a valve connected to said solenoid valve.

* * * * *